US006013309A

United States Patent [19]

Kim et al.

[11] Patent Number: 6,013,309

[45] Date of Patent: Jan. 11, 2000

[54] PROTECTION LAYER OF PLASMA DISPLAY PANEL AND METHOD OF FORMING THE SAME

[75] Inventors: Jin Young Kim, Kyungsangbuk-do, Rep. of Korea; Sen Gouk Kim, Oreol, Russian Federation; Myung Ho Park; Jae Hwa Ryu, both of Kyungsangbuk-do, Rep. of Korea

[73] Assignee: LG Electronics Inc., Seoul, Rep. of Korea

[21] Appl. No.: 08/950,975

[22] Filed: Oct. 15, 1997

[30] Foreign Application Priority Data

Feb. 13, 1997 [KR] Rep. of Korea ..... 97-4268
Mar. 18, 1997 [KR] Rep. of Korea ..... 97-9078

[51] Int. Cl.[7] ..... B05D 5/12; B05D 5/06

[52] U.S. Cl. ..... 427/68; 427/64; 427/126.3; 427/376.2

[58] Field of Search ..... 427/58, 64, 68, 427/78, 126.3, 376.2; 313/479, 587

[56] References Cited

U.S. PATENT DOCUMENTS 5,770,921 6/1998 Aoki et al. ..... 313/581

FOREIGN PATENT DOCUMENTS

0554172A1 1/1993 European Pat. Off. .

OTHER PUBLICATIONS

K. Amano et al. "21.3: Characteristics of Thick–Film–Printed MgO for a Practical Use in ac Plasma Displays" SID No Month Available 94 Digest, pp. 323–326.

*Primary Examiner*—Brian K. Talbot
*Attorney, Agent, or Firm*—Fleshner & Kim

[57] ABSTRACT

A method of forming a protection layer of a plasma display panel, which has upper electrodes, lower electrodes and a barrier rib, includes the steps of: forming a dielectric layer on the upper electrodes; and forming a MgO protection layer on the dielectric layer by the method of direct coating the MgO solution on the surface of the dielectric layer. Some advantages are derived by properly mixing MgO particles, salt containing Mg, and organic binder and coating an MgO protection layer (thin film) on the surface of the PDP substrate irrespective of coating methods by simple facility and processing. These advantages include PDP MgO protection layer formation to reduce PDP production cost, time and firing voltages, and adjustment of the protection layer's thickness.

20 Claims, 2 Drawing Sheets

PROTECTION LAYER OF PLASMA DISPLAY PANEL AND METHOD OF FORMING THE SAME

BACKGROUND OF THE INVENTION

1. Field of the Invention

The present invention relates to a protection layer of a PDP (Plasma Display Panel) and a method of forming the same and, more particularly, to a protection layer of a PDP and a method of forming the same by which an excellent protection layer can be formed on the surface of the PDP's substrate.

2. Discussion of Related Art

FIG. 1 is a cross section of a general PDP. As shown in FIG. 1, the PDP comprises: an upper structure having a pair of upper electrodes 4 formed on the same surface of a front glass substrate 1, a dielectric layer 2 formed on the upper electrodes 4 by printing method, and a thin film 3 (hereinafter, referred to as protection layer) deposited on the dielectric layer 2; a lower structure having lower electrodes 12 formed on a back glass substrate 11, a barrier rib 6 formed to prevent a mis-discharge in the cell adjacent to the lower electrodes, and phosphor 8, 9 and 10 formed around the barrier rib 6 and the lower electrodes 12; and a discharging region 5 formed in a space between the upper and lower structures by injecting an inert gas therein.

The lower electrodes 12 are termed "data electrodes" into which image data is transferred. The upper electrodes 4 are termed "display electrodes" comprising a scan electrode for discharging the image data fed into the cell, and a sustain electrode to maintain the cell's discharging.

The PDPs as constructed above are widely used as a flat display device because they can display signals at high speed and be manufactured in a large size.

Referring to FIG. 1, when an image data is transferred into the lower electrodes 12 and a discharging signal is fed into the scan electrode of the upper electrodes, a driving voltage is applied to the discharging space between the upper and lower electrodes, creating a surface discharge in the discharging region 5 on the surfaces of the dielectric and protection layers 2 and 3. Such a surface discharge causes ultraviolet radiation while the signal is entered.

Because the ultraviolet radiation does not last long enough to display signals, the discharging and sustain signals respectively applied by the scan and sustain electrodes of the upper electrodes 4 provide extra discharging time for a display while no image data is entered through the lower electrodes 12.

The ultraviolet ray 7 excites the phosphor 8, 9 and 10 to display color signals.

Electrons in the discharging cell are accelerated towards the negative (−) electrode by a driving voltage applied, colliding with a penning mixture gas consisting of mainly inert gases, i.e., He and additional Xe, Ne, or other gases. Thus excited inert gas generates the ultraviolet ray 7 having the wavelength of 147 nm. The ultraviolet ray 7 collides with the phosphor 8, 9 and 10 that surround the lower electrodes 12 and the barrier rib 6, to generate a light in the ultraviolet spectrum region.

PDPs must have the protection layer 3 on the whole surface of the dielectric layer to protect the dielectric layer 2 against sputtering effect caused by a secondary emission during a discharge, the protection layer 3 usually being a transparent layer consisting of magnesium oxide (hereinafter, referred to as MgO). The protection layer 3 protects the dielectric layer 2 of the cells to extend the life of the panel and reduce the driving voltages.

A conventional method of forming the protection layer 3 is disclosed in SID 94 DIGEST (P 323–326, by Amano), by which a MgO paste is prepared from MgO powder mixture in a solvent, screen printed to form an MgO protection layer 2 $\mu$m thick and heated at 500° C.

Such a screen printing can be performed at low costs for materials and available as an alternative new technique. It is applicable to MgO deposition on a glass substrate of an AC PDP but not appropriate in a difficult deposition of a MgO thick layer due to the PDP's characteristics.

As disclosed in European Patent Application No. 93400201.5(Publication No. EP0554172A1), a Mgo protection layer of several hundreds of nanometers in thickness might be coated by a vacuum method. The vacuum method is an E-beam and RF (Radio Frequency) sputtering that is expensive and inefficient in productivity due to its complex process such as vacuum and heat treatment. In addition, there are other limitations associated with the vacuum method, including firing voltage reduction and prevention of ion collisions to increase the device's life during a sputtering.

SUMMARY OF THE INVENTION

Accordingly, the present invention is directed to a protection layer of a PDP and a method of forming the same that substantially obviates one or more of the problems due to limitations and disadvantages of the related art.

An object of the present invention is to provide a protection layer of a PDP and its formation by which a protection layer can be coated with more ease by preparing a MgO solution (a solution containing Mg) for MgO protection layer formation.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of forming a protection layer of a plasma display panel, which has upper electrodes, lower electrodes and a barrier rib, includes the steps of: forming a dielectric layer on the upper electrodes; and forming a Mgo protection layer on the dielectric layer by the method of direct coating the MgO solution on the surface of the dielectric layer.

A method of forming such as printing, spraying, dipping and spin coating or the like a plasma display panel protection layer, which is to form a MgO protection layer on the surface of a substrate of a plasma display panel, includes the steps of: preparing a MgO solution which is a mixture MgO particles, salt containing Mg, and organic solvents; coating the MgO solution on the surface of the substrate; and performing a firing of the coated substrate.

In a MgO solution for forming a MgO thin film on a substrate for a plasma display panel, a MgO protection layer for the plasma display panel consists of MgO particles, salt containing Mg, and organic solvents.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Figure 1:
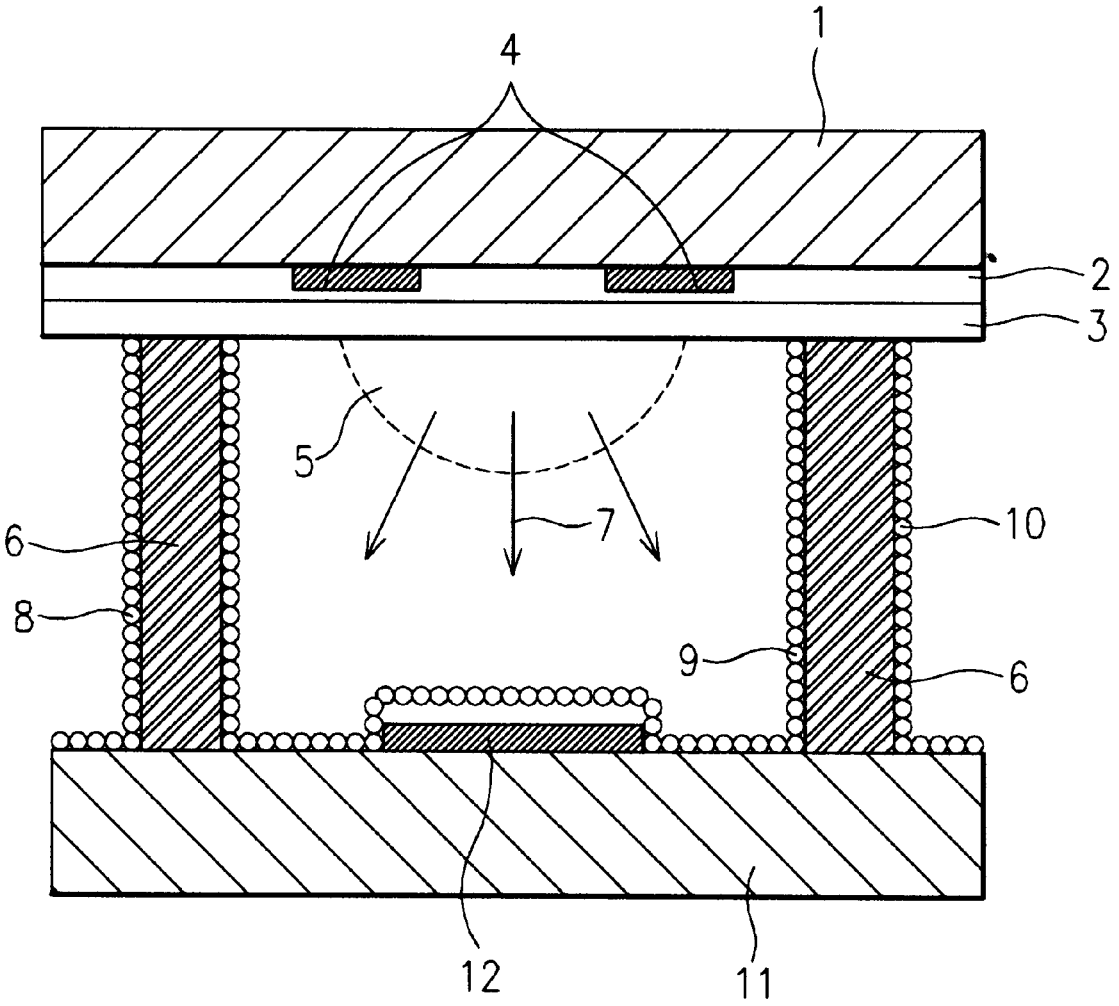
FIG. 1 Conventional Art
FIG. 1 is a cross section of a general PDP.

Reference will now be made in detail to the preferred embodiments of the present invention, examples of which are illustrated in the accompanying drawings.

According to the present invention, a protection layer 3 is made from a MgO solution for MgO protection layer formation which consists of transparent MgO particle, salt containing Mg and organic solvent.

First, a pair of upper electrodes 4, which are termed scan and sustain electrodes, are formed on an upper insulating substrate 1. The upper electrodes 4 typically use a transparent ITO (Indium Tin Oxide) electrode consisting of either indium oxide or tin oxide layer deposited.

To limit the upper electrodes 4's current that might occur in a complete cell during a discharge, a dielectric layer is formed by printing a dielectric material paste containing mainly lead oxide. Drying and firing follows the dielectric layer formation.

A protection layer 3 is then formed by using a MgO solution in order to prevent the dielectric layer from being damaged by a sputtering during a discharge of the upper electrodes 4.

To prepare a MgO solution, a certain Mg compound is first mixed with neutral materials such as alcohol, acetic acid ($CH_3COOH$), ethyl alcohol ($C_2H_5OH$) or the like to produce a diluted solution. Particles contained in the solution are dissolved by action of ultrasonic wave, the diluted solution being mixed with nitric acid. Note that the particles in the solution should not completely dissolved and particle size is preferably in the range between 0.01 $\mu$m and 0.5 $\mu$m.

The MgO solution consists of Mg compound of 1% to 10% by weight, acetic acid of 1% to 10% by weight, ethyl alcohol of 80% to 95% by weight, and nitric acid of 1% to 10% by weight. Thus prepared MgO solution is coated by general coating methods such as spin coating, printing, spraying or the like.

Lower electrodes are formed on a lower insulating substrate, and an insulating paste is coated by using a printing method to form barrier rib forming a discharging cell.

Phosphor are arranged in the discharging region in the cell. The upper and lower insulating substrates are combined by using a frit glass, followed by introducing discharging gas therein and completely sealing.

The following description relates to a material mixing process for MgO solution in accordance with the present invention.

A MgO solution formation contains MgO particles in the proportion of 0.01% to 0.2% by weight, preferably, 0.03% to 0.15% by weight, most preferably, 0.04% to 0.1% by weight. The MgO particle size is between 0.1 $\mu$m and 0.5 $\mu$m, most preferably, between 0.2 $\mu$m and 0.4 $\mu$m.

Salt containing Mg consists of $Mg(NO_3)$, $MgCl_2$, and $Mg(CH_3COO)_2$ in the proportion of 0.35% to 7.0% by weight, preferably, 1.5% to 5.0% by weight, most preferably, 2.0% to 4.0% by weight.

The other components are organic solvents such as ethanol, acetone, or methyl-ethyl ketone.

The MgO solution is then coated on the surface of the dielectric by an appropriate technique for the use purpose; for example, coating the solution by fixing a certain gap between the dielectric and squeeze. The squeeze should have a uniform surface, used in various forms such as tube, core, or rod type. The squeeze is made of glass or metals such as titanium that do not react with the MgO solution.

Other formation techniques include spray, dipping, and spin coating techniques.

Following the MgO solution coating, organic solvents are vaporized for 5 minutes to leave salts containing initial MgO particles.

Thus coated substrate is then fired at temperature above 400° C., preferably, above 420° C., most preferably, above 450° C. Firing is carried out at the maximum temperature for 5 to 20 minutes, preferably, 10 to 15 minutes. The firing temperature is gradually increased up to the above temperatures for 40 to 120 minutes, preferably, 60 to 90 minutes.

Cooling time after the firing is approximately 40 to 120 minutes, preferably, 60 to 120 minutes.

According to the present invention, unwanted materials are vaporized from the salt by the above-mentioned process.

After firing, Mgo particles are created from the salt and adhere to the existing MgO particles that function as a seed to start the growth of MgO.

First Embodiment 1

Figure 2:
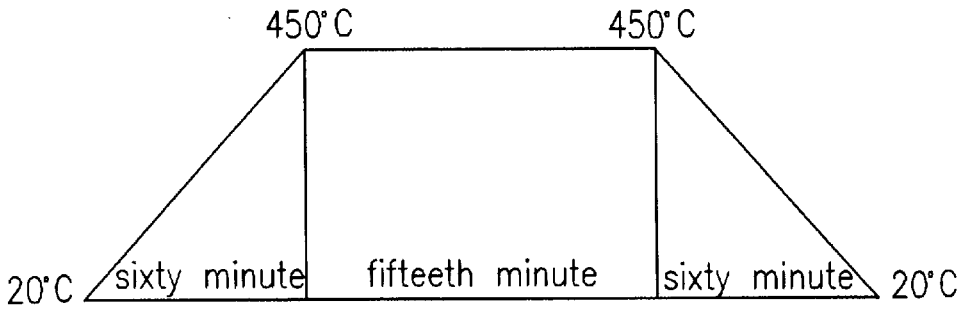
FIG. 2 is a graph showing temperature conditions of heat treatment in accordance with the present invention.

After a MgO solution 100 g is prepared by the composition as shown in Table 1 and coated on the substrate, the substrate is placed in a belt furnace and heat-treated in a manner as illustrated in FIG. 2.

| MgO SOLUTION COMPONENTS | wt. % |
|---|---|
| MgO PARTICLE | 0.08 |
| $Mg(NO_3)_2$ | 0.9 |
| $MgCl_2$ | 0.2 |
| $Mg(CH_3COO)_2$ | 3.3 |
| $C_2H_5OH$ | 95.52 |
| TOTAL | 100 wt % |

Second Embodiment

The MgO solution 100 g prepared by the composition as shown in Table 2 is treated in the same manner as in the first embodiment.

| MgO SOLUTION COMPONENTS | wt. % |
|---|---|
| MgO PARTICLE | 0.12 |
| $Mg(NO_3)_2$ | 0.85 |
| $MgCl_2$ | 0.15 |
| $Mg(CH_3COO)_2$ | 3.4 |
| $C_2H_5OH$ | 80.48 |

-continued

| MgO SOLUTION COMPONENTS | wt. % |
|---|---|
| $CH_3COC_2H_5$ | 15.0 |
| TOTAL | 100 wt % |

Figure 3:
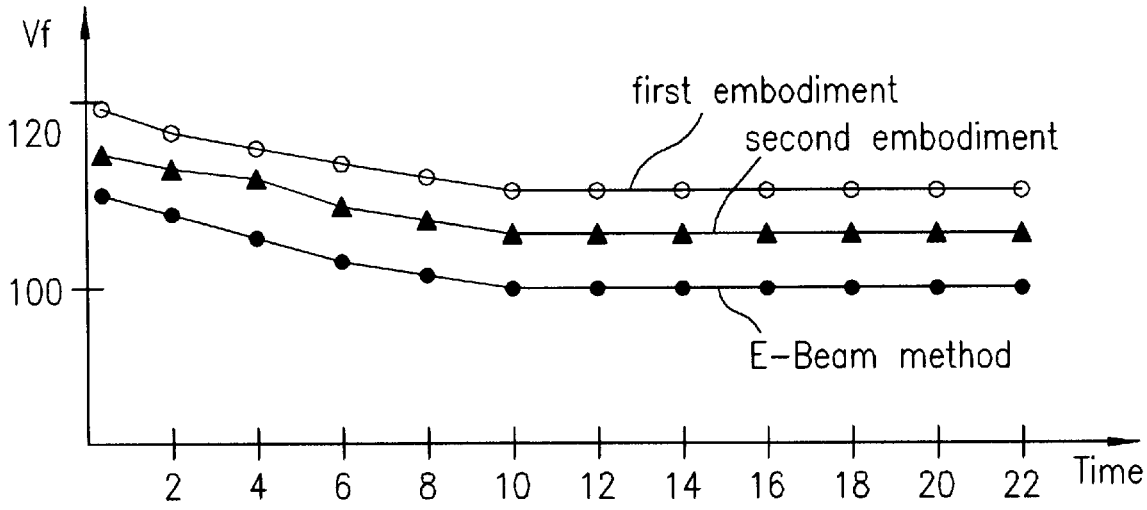
FIG. 3 is a graph of electrical characteristics of the present invention.

A MgO thick layer completed through the first and second embodiments is used to produce an AC PDP cell as shown in FIG. 1. Measurements of the firing voltage result in FIG. 3. As seen in FIG. 3, the AC PDP cell of the present invention has more excellent electrical characteristic than that manufactured by E-beam method. Because the difference in the electrical characteristic between the AC PDP cells produced by the present invention and E-beam method is insignificant, the AC PDP can be formed by either method.

As described above, some advantages are derived by properly mixing MgO particles, salt containing Mg, and organic solvent and coating an MgO protection layer (thin film) on the surface of the PDP substrate irrespective of coating methods by simple facility and processing. These advantages include PDP MgO protection layer formation to reduce PDP production cost, time and firing voltages, and adjustment of the protection layer's thickness.

It will be apparent to those skilled in the art that various modifications and variations can be made in the protection layer of a PDP and a method of forming the same according to the present invention without departing from the spirit or scope of the invention. Thus, it is intended that the present invention cover the modifications and variations of this invention provided they come within the scope of the appended claims and their equivalents.

What is claimed is:

1. A method of forming a protection layer of a plasma display panel, which has upper electrodes, lower electrodes and barrier ribs, the method comprising the steps of:

forming a dielectric layer on the upper electrodes;

preparing a MgO solution which is a mixture of Mg compound, acetic acid, ethyl alcohol, and nitric acid; and forming a MgO solution protection layer on the dielectric layer by the method of direct coating the MgO solution on a surface of the dielectric layer.

2. The method as defined in claim 1, wherein the method of direct coating is one of printing, spin coating, spraying, or dipping.

3. The method as defined in claim 1, wherein the Mg compound is added in the proportion of approximately 1% to 10% by weight.

4. The method as defined in claim 1, wherein the acetic acid is added in the proportion of approximately 1% to 10% by weight.

5. The method as defined in claim 1, wherein the ethyl alcohol is added in the proportion of approximately 80% to 95% by weight.

6. The method as defined in claim 1, wherein the nitric acid is added in the proportion of approximately 1% to 5% by weight.

7. The method of claim 1, wherein the MgO solution is a mixture of 1–10% by weight Mg compound, 1–10% by weight acetic acid, 80–95% by weight ethyl alcohol, and 1–5% by weight nitric acid.

8. The method of claim 1, wherein the MgO solution comprises MgO particles having a particle size of 0.1 $\mu$m to 0.5 $\mu$m.

9. A method of forming a plasma display panel protection layer, which is to form a MgO protection layer on a surface of a substrate of a plasma display panel, the method comprising the steps of:

forming a dielectric layer on the surface of the substrate;

preparing a MgO solution which is a mixture of MgO particles and acetic acid, salt containing Mg, and organic solvents;

coating the MgO solution directly on the dielectric layer;

vaporizing the organic solvents to leave salts containing initial MgO particles; and performing a firing of the coated substrate.

10. The method as defined in claim 9, wherein the MgO solution of 100% by weight consists of the MgO particles having a particle size of 0.1 $\mu$m to 0.5 $\mu$m in the proportion of 0.01% to 0.2% by weight, the salt containing Mg of 0.35% to 7.0% by weight, and the organic solvents for the rest.

11. The method as defined in claim 9, wherein the firing is performed at temperature between 400° C. and 500° C. for 5 to 20 minutes.

12. A method of forming a protection layer of a plasma display panel, the method comprising the steps of:

forming a dielectric layer on the display panel;

directly coating an MgO solution comprising suspended MgO particles on a surface of the dielectric layer wherein said MgO solution further comprises acetic acid; and drying the MgO solution whereby said acetic acid prenvents the MgO particles from resettling, to form a protective layer on the dielectric layer.

13. The method of claim 12, wherein the MgO solution further comprises an agent which controls the drying speed of the MgO solution such that the protective layer has a uniform thickness.

14. The method of claim 13, wherein the agent comprises ethyl alcohol.

15. The method of claim 12, wherein the MgO solution further comprises Mg compound, ethyl alcohol, and nitric acid.

16. The method of claim 15, wherein the MgO solution is a mixture of 1–10% by weight Mg compound, 1–10% by weight acetic acid, 80–95% by weight ethyl alcohol, and 1–5% by weight nitric acid.

17. The method of claim 12, wherein the MgO solution is directly coated on the surface of the dielectric layer by one of printing, spin coating, spraying, and dipping.

18. The method of claim 12, wherein the MgO particles have a particle size of 0.1 $\mu$m to 0.5 $\mu$m.

19. The method of claim 12, wherein the step of drying the MgO solution comprises firing the coated dielectric layer at a temperature of approximately 450° F. for approximately 15 minutes.

20. The method of claim 12, wherein the step of drying the MgO solution comprises firing the coated dielectric layer at a temperature greater than 400° F. but less than 500° F. for more than 5 minutes but less than 20 minutes.

* * * * *